United States Patent [19]

Maruyama

[11] 4,157,781

[45] Jun. 12, 1979

[54] SELF BALANCING CENTRIFUGE

[76] Inventor: Hitoshi Maruyama, 205 Garden Spot Dr., Hagerstown, Md. 21740

[21] Appl. No.: 926,095

[22] Filed: Jul. 19, 1978

[51] Int. Cl.[2] ..... B04B 5/02

[52] U.S. Cl. ..... 233/23 A; 233/26

[58] Field of Search ..... 233/1 C, 23 A; 74/573 R, 573 F; 210/144, 145

[56] References Cited

U.S. PATENT DOCUMENTS

| | | | |
|---|---|---|---|
| 3,330,168 | 7/1967 | Kahn | 210/144 X |
| 3,799,348 | 3/1974 | Mazza | 210/144 |
| 3,921,898 | 11/1975 | Finkel | 233/23 A |

FOREIGN PATENT DOCUMENTS

| | | | |
|---|---|---|---|
| 51902 | 5/1890 | Fed. Rep. of Germany | 210/144 |
| 2057004 | 3/1972 | Fed. Rep. of Germany | 233/1 C |

*Primary Examiner*—George H. Krizmanich

*Attorney, Agent, or Firm*—Lowe, King, Price & Becker

[57] ABSTRACT

A centrifuge comprises a pair of sample containers supported, respectively, on opposite ends of a horizontal rotor that is spun by a drive motor about a vertical rotation axis. The sample containers carry storage tanks for fluid that is automatically distributed between the tanks for balancing prior to centrifuging. Any weight imbalance between the loaded sample containers is measured by a pair of pressure transducers located between the rotor and a stationary, annular support member. Electronic circuitry monitors the outputs of the pressure transducers and in response controls a servo operated valve to redistribute the balancing fluid between the storage tanks under the force of an external vacuum source. Digital logic prevents energization of the drive motor for centrifuging the samples until the load is balanced.

15 Claims, 11 Drawing Figures

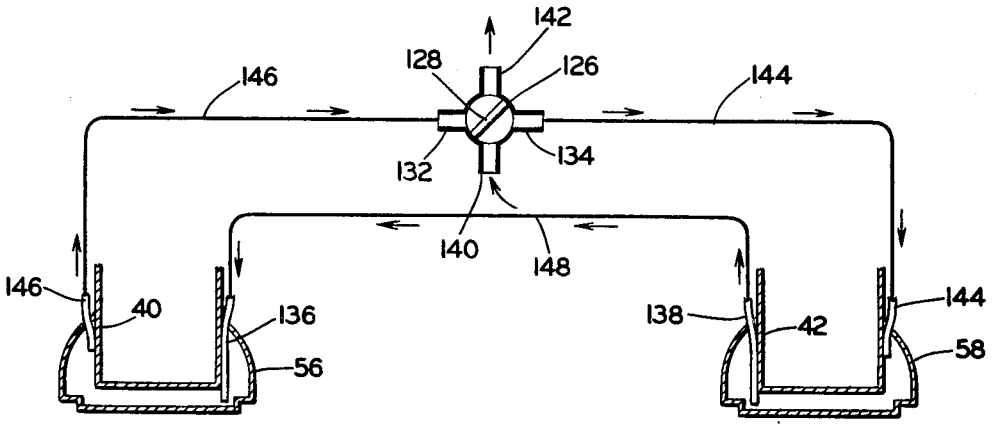
FIG. 8
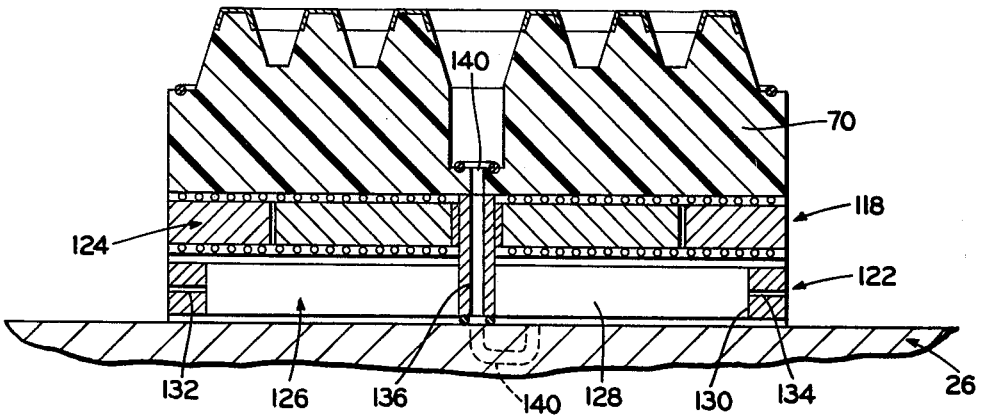
FIG. 9
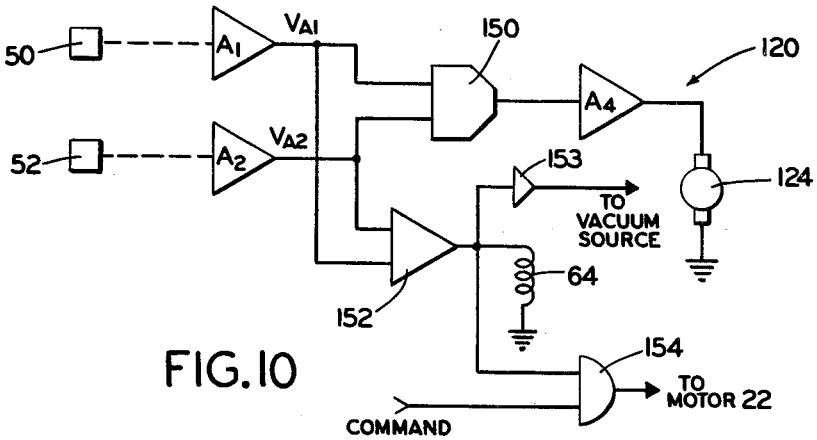
FIG. 10
FIG. 11
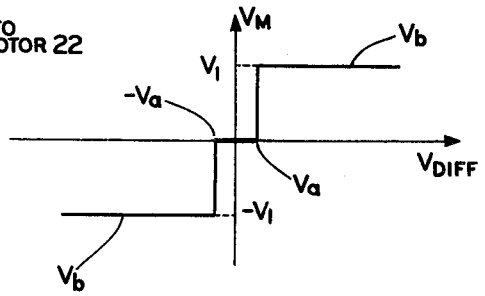

SELF BALANCING CENTRIFUGE

TECHNICAL FIELD

The present invention relates generally to centrifuges, and more particularly toward an improved self balancing centrifuge wherein fluid is automatically distributed between a pair of sample containers to balance the rotor prior to centrifuging.

BACKGROUND ART

Centrifuge apparatus adapted to separate liquid samples based on density generally contain a plurality of containers mounted on the ends of a series of outwardly extending rotor arms and into which are located detachably mounted sample inserts. Best operation of the centrifuge occurs when the system is perfectly balanced with each of sample containers containing an identical amount of sample liquid. In practice, however, the load on a centrifuge rotor is seldom balanced. In a typical procedure, the number of samples processed may be less than the number of centrifuge components available. Also, the amounts of fluid sample among the various sample compartments are generally different. Under an imbalanced condition, as the rotor is spun, vibrations are generated that tend to damage the motor bearing and may lead to beqring failure. Also, vibrations reduce the safe operable speed of the rotor and tend to agitate any interface formed between constituents of a sample being separated. In an extreme case, failure of the motor bearing may cause destruction of the centrifuge during a "run".

Several self-balancing systems have been developed in order to cause the centrifuge to become balanced during a run in order to avoid the problems described above. These systems, such as the one disclosed in Finkel U.S. Pat. No. 3,921,898, typically provide a mass distribution means, such as fluid or solid weights, that are automatically distributed among the sample containers to equalize or balance the centrifuge rotor about its vertical motor drive shaft. Mass redistribution systems provided in automatic balancing systems for centrifuges, of which I am aware, cause the balancing fluid or solid weights to be distributed about the center of rotation of the rotor during a run, not before. Although balancing is completed within a relatively short period of time, the rotor does spin in an unbalanced condition until steady state rotation is reached. In circumstances when only a minor initial imbalance exists, there is no substantial deleterious effect caused to the sample or centrifuge. In circumstances where there is a significant initial imbalance, on the other hand, significant stresses on the motor bearing from start up to steady state are created, reducing the life time of the bearing and interfering with stratification of the samples. In extreme cases, the entire centrifuge has been known to become unstable, resulting in an explosion of the centrifuge mechanism. A need exists, therefore, for a self balancing centrifuge, wherein balancing is automatically completed in a static mode, that is, prior to a centrifuge run.

One object of the present invention, therefore, is to provide a new and improved centrifuge, wherein automatic, static balancing is made.

Another object is to provide a new and improved, self-balancing centrifuge of a type having balancing fluid storage tanks carried by the sample containers, wherein distribution of fluid among the tanks for balancing is made prior to rotation of the centrifuge rotor.

Another object is to provide a new and improved method of balancing a centrifuge, wherein the total mass carried by the rotor is re-distributed for balancing prior to rotation of the centrifuge rotor to eliminate the possibility of centrifuging in an unbalanced condition.

DISCLOSURE OF INVENTION

The above objects are satisfied in accordance with the present invention by providing a centrifuge assembly having a horizontal rotor member that is mounted on and keyed to rotate with the vertical drive shaft of an electric motor. A pair of sample containers are pivotally supported, respectively, on opposite ends of the rotor in the usual manner to enable the containers to swing from a vertical position to substantially a horizontal position in response to centrifugal force applied on the containers during rotation. Each sample container is positioned within a jacket functioning as a tank adapted to receive and store balancing fluid distributed selectively between the two containers for balancing prior to spinning of the rotor. The flow of balancing fluid between the two storage tanks or jackets is controlled by a rotary valve that is indexed in response to a pair of pressure transducers which monitor any weight imbalance of the rotor and load with respect to the center of rotation.

A horizontal pressure member is rigidly attached to the motor shaft and extends outwardly to contact the underside of the horizontal rotor at contact points equally spaced from the shaft. The motor shaft is loosely coupled to the rotor at the rotor spin axis so that the rotor is able to pivot slightly on the shaft. The pair of pressure transducers are located between the opposite ends of the support member and rotor and generate electrical signals that are a function of the pressure applied against the transducers by each side of the rotor as it pivots on the motor shaft in response to any rotor imbalance prior to spinning. Any difference in signal magnitudes generated by the two pressure transducers is a function of weight imbalance of the rotor and load on opposite sides of the spin axis. A difference signal is developed and supplied to a servo that operates a rotary valve which re-distributes the balancing fluid between the two balancing tanks associated with the sample containers until a balanced condition is indicated.

The balancing fluid is distributed between the tanks through the rotary valve under pneumatic force applied by an external source. The source is connected to the valve through a vacuum line attached to a set of male and female couplers above the rotor. The vacuum line is attached to an inlet port of the male coupler which is controlled by a solenoid to index into the female coupler during a balancing operation. The female coupler is stationary on the rotor and houses the rotary valve as well as the valve servo.

Voltage for operating the rotary valve servo and signal processing circuitry is supplied from an external source through electrical contacts formed in the male and female couplers. The contacts also establish electrical connections between the pressure transducers and external signal processing and control circuitry. The male coupler is normally maintained separated from the female coupler by the electric solenoid that is energized whenever the pressure transducers indicate that the rotor is balanced. Spinning of the rotor can take place only when the couplers are separated. Where there is an imbalance, however, the solenoid is de-energized by control circuitry, causing the male coupler to index into mating contact with the female coupler under the force of gravity. When mated, the two couplers establish (1) electrical connections from the external voltage supply to the valve servo as well as from the external signal processing and control circuitry to the transducers and (2) a pneumatic circuit from the external vacuum line to the rotary valve and balancing tanks. The electrical contacts on the female and male couplers are annular and positioned about the spin axis while the vacuum line is on the spin axis so that the relative angular position of the two couplers does not effect electrical or pneumatic continuity.

BRIEF DESCRIPTION OF DRAWINGS

FIG. 8 is a schematic diagram showing transfer of balancing fluid from the right hand storage tank to the left hand storage tank during the static balancing mode of operation;

FIG. 9 is a cross-sectional view of the female coupler showing the valve drive servo and rotary valve housed in the female coupler;

FIG. 10 is a block diagram showing the signal processing and control circuitry; and FIG. 11 is a graph showing the dead band transfer function of the comparator shown in FIG. 10.

BEST MODE FOR CARRYING OUT THE INVENTION

Figure 1:
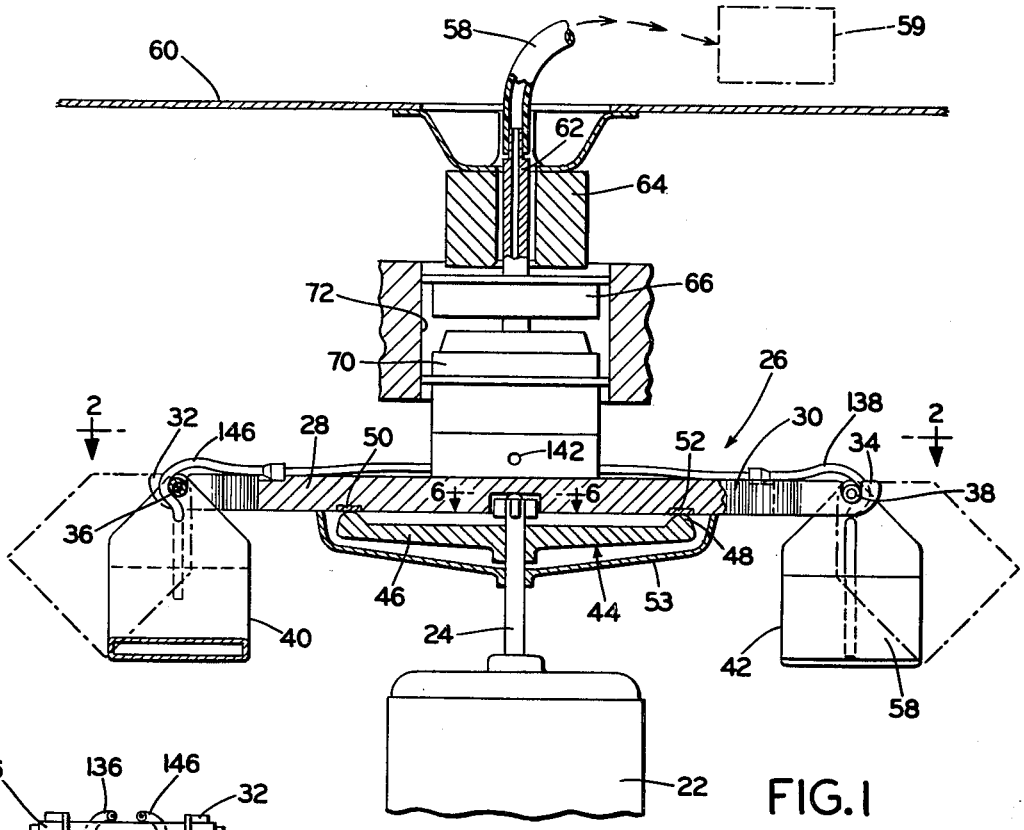
FIG. 1 is a front view of a centrifuge, in accordance with the invention, with portions shown in cross section to expose structural details.
Figure 2:
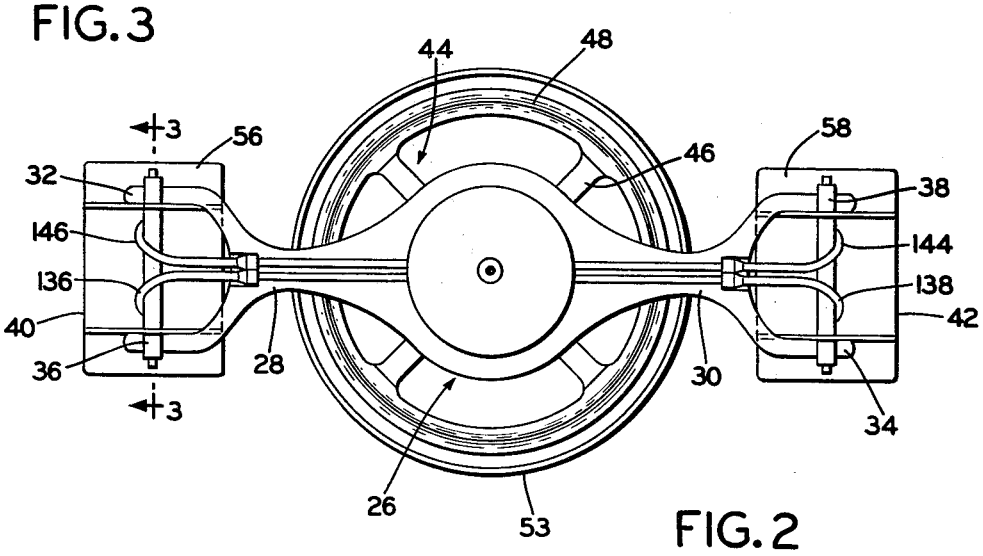
FIG. 2 is a top view of the centrifuge shown in FIG. 1.

Referring to FIGS. 1 and 2, a centrifuge 20, in accordance with the invention, comprises an electric motor 22 having a vertical drive shaft 24 onto which is mounted a horizontal rotor assembly 26. The rotor assembly 26 is composed of a pair of outwardly extending rotor arms 28 and 30 having supporting ends 32 and 34 onto which are positioned, respectively, hangers 36 and 38. The hangers 36 and 38 are attached to sample containers 40 and 42 adapted to receive removeable test tube inserts (not shown), such as part number 00575 of the GLC-2B General Laboratory Centrifuge manufactured by Dupont Instruments.

A pressure member 44 is secured at its spin axis to motor shaft 24 and extends outwardly along spokes 46 to an annular support pad 48. The support pad 48 is maintained in contact with a pair of pressure transducers 50, 52 imbedded in the lower surface of rotor 26, as shown in FIG. 1, but is not bonded or otherwise secured to the transducers. A shroud 53 is located between motor shaft 24 and rotor 26 to reduce wind resistance on the pressure member 44 during spinning. The shroud 53 is formed of a thin, resilient material so as to yield to any pivoting of the rotor 26 on motor shaft 24 during a balancing cycle, as discussed in more detail below.

Figure 6:
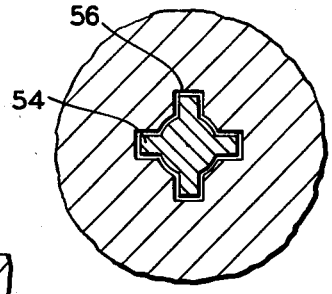
FIG. 6 is a cross-sectional view of the coupling between the motor drive shaft and horizontal rotor assembly taken along the line 6—6 in FIG. 1.

The rotor 26 is loosely coupled to and keyed to rotate with drive shaft 24 by diametrically opposed pairs of tabs 54 (see FIG. 6) formed on the end of the shaft and adapted to innerfit to a correspondingly formed opening 56 in the underside of the rotor 26 at its center of rotation. The opening 56 is slightly oversized to provide clearance between the supporting end of the shaft 24 at tabs 54 and the rotor to enable some limited pivoting about the end of the drive shaft. Thus, as can be best appreciated with reference to FIG. 1, the rotor assembly 26 is pivotally mounted with its center of rotation on the vertical drive shaft 24 but is stabilized at two points 50 and 52 by the rigid pressure member 44.

Of particular importance, the pressure member 44 applies pressures to pressure transducers 50 and 52 that are functions, respectively, of the weights of rotor arms 28, 30 and their loads 40, 42. Since transducers 50 and 52 are equispaced from the center of rotation of rotor 26, however, and since the two rotor arms 28 and 30 as well as respective sample containers 40 and 42 are identical in configuration and mass, it can be appreciated that any difference in the pressures applied by pressure member 44 to the transducers 50 and 52 is a function of only difference in weight between the contents of sample containers 40 and 42. The term "contents" is defined herein as being the sample load together with balancing fluid, described below.

Figure 3:
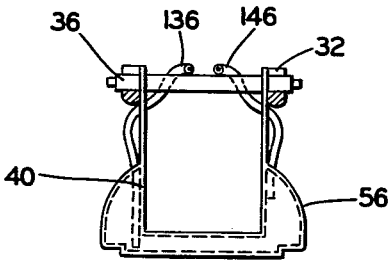
FIG. 3 is a cross-sectional view of a sample container and storage tank assembly taken along the line 3—3 in FIG. 2.

Referring to FIG. 3, each of the sample containers 40 and 42 (only sample container 40 is shown in FIG. 3) is provided with a skirt 56 that functions as a storage tank for balancing fluid to be supplied to the tank during a balancing mode of operation prior to spinning of the centrifuge. The tank 56 is located below the center of gravity of the sample container 40 for increased stability. The total weight of each sample container is thus the weight of the container itself, the weight of the insert and samples and the weight of any balancing fluid in the tank 56. A similar tank 58 is provided on opposite container 42.

The total amount of balancing fluid contained in storage tanks 56, 58 is constant since the fluid system is closed. Balancing of weight between the two sample containers 40 and 42 is thus provided by re-distributing balancing fluid between the containers in response to an imbalance signal generated by pressure transducers 50 and 52 prior to centrifuging. The flow of balancing fluid between the containers 40 and 42 is caused by an external source of pneumatic force, such as vacuum pump 59 that supplies negative pressure to the centrifuge assembly through a flexible vacuum line 58 (FIG. 1). The line 58 extends through an upper support 60 to an inlet 62 formed of metal. The metal inlet 62 also functions as a plunger for a solenoid defined by electric coil 64 and the inlet. The metal inlet 62 extends through the core of the electric coil 64 and is end threaded to a male coupler 66, a shown in FIG. 4. A central bore 68 in the coupler 66 forms an extension of central bore 69 in the inlet 62 to couple the external vacuum pump 59 to a female coupler 70 positioned directly below the male coupler and in contact with the upper surface of rotor 26.

Figure 5:
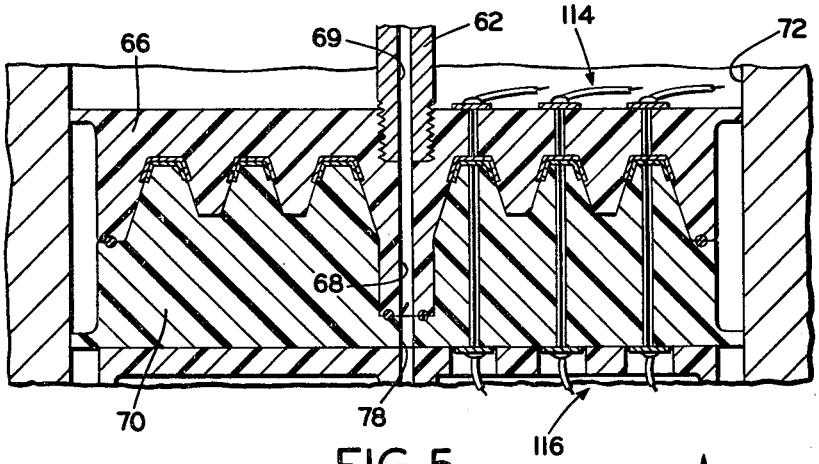
FIG. 5 is a cross-sectional view of the couplers in a mating position.

The male coupler 66 and female coupler 70 are each disc-shaped and mounted within a cylindrical bearing 72 to retain the two couplers in vertical alignment to each other. The male coupler 66 contains a central extending member 74 defining the bore 68, whereas the female coupler 70 contains a corresponding central recess 76 adapted to receive the extending male member 74. Female coupler 70 is provided with a central bore 78 that forms an extension of the male bore 68 when the male and female couplers are mated, as shown in FIG. 5. An O-ring seal 80 seals the vacuum circuit portion defined by bores 68 and 78 during mating of the couplers. A oneway valve (not shown) may be provided at seal 80 to prevent reverse flow of air from bore 68 to bore 78.

Male coupler 66 is formed with a series of concentric rims defined by circular ridges 82 and circular valleys 84. The female coupler 70 is also formed with concentric rings defined by ridges 86 and valleys 88 that are complementary to male ridges 82 and valleys 84. When the male coupler 66 and female coupler 70 are mated, female ridges 86 interfit with male valleys 84 whereas the male ridges 82 interfit with female valleys 88, as shown in FIG. 5. Similarly, the male extending member 74 is snugly fitted within female recess 76.

Figure 4:
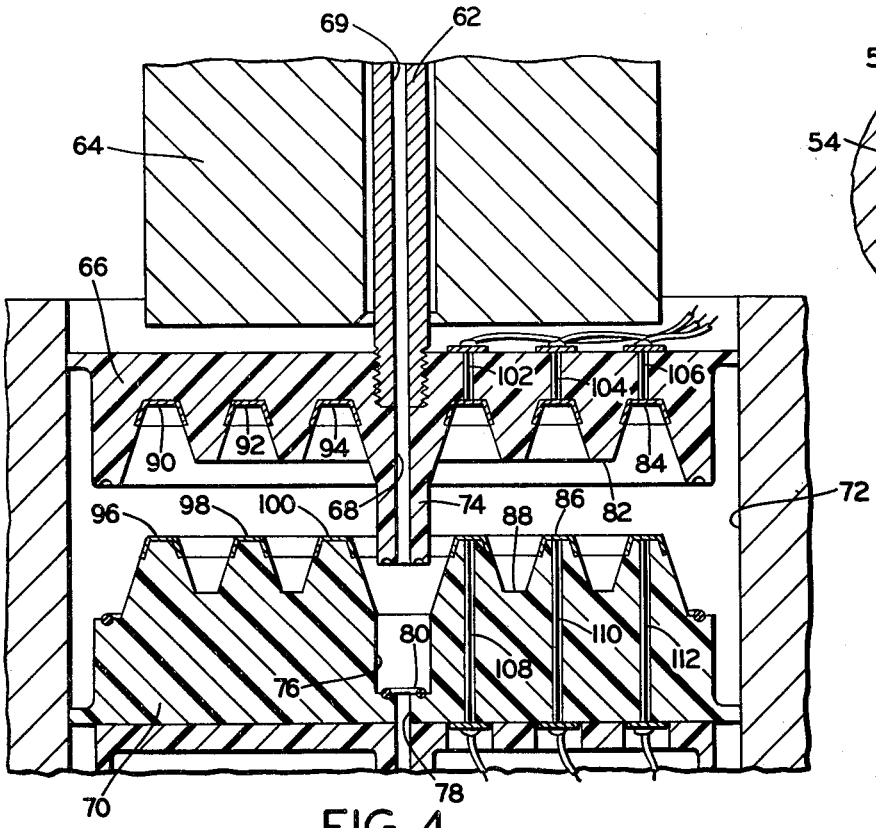
FIG. 4 is a cross-sectional view of the male and female couplers in a separated position.

Within each valley 84 of the male coupler 66 is a ring shaped, electrical terminal 90, 92 and 94. Corresponding ring shaped, electrical terminals 96, 98 and 100 are located on the ridges 86 of the female coupler 70. Each of the electric terminals 90, 92 and 94 is electrically isolated from each other by the insulating body of male coupler 66. Similarly, each of the terminals 96, 98 and 100 is electrically isolated from each other by the insulating body of female coupler 70. When the male coupler 66 and female coupler 70 are separated from each other as shown in FIG. 4, the male and female coupler terminals are isolated from each other by the air gap formed therebetween. Electrical contact between the male and female terminals 90 and 96, between terminals 92 and 98, and between terminals 94 and 100 are established during mating of the two couplers 66 and 70, as shown in FIG. 5.

Electrical connections between male coupler terminals 90, 92 and 94 are made to external voltage supply sources through conducting pins 102, 104 and 106 extending upwardly through the body of male coupler 66. The female coupler terminals 96, 98 and 100, on the other hand, are electrically connected to servo 124 (FIG. 9) housed within the female coupler and to transducers 50, 52 through conducting pins 108, 110 and 112 extending downwardly through the body of the female coupler. Accordingly, when the male coupler 66 and female coupler 70 are mated, as in FIG. 5, electrical continuity is established between voltage supply wires 114 and transducer and servo wires 116 extending into the female coupler 70.

Figure 7:
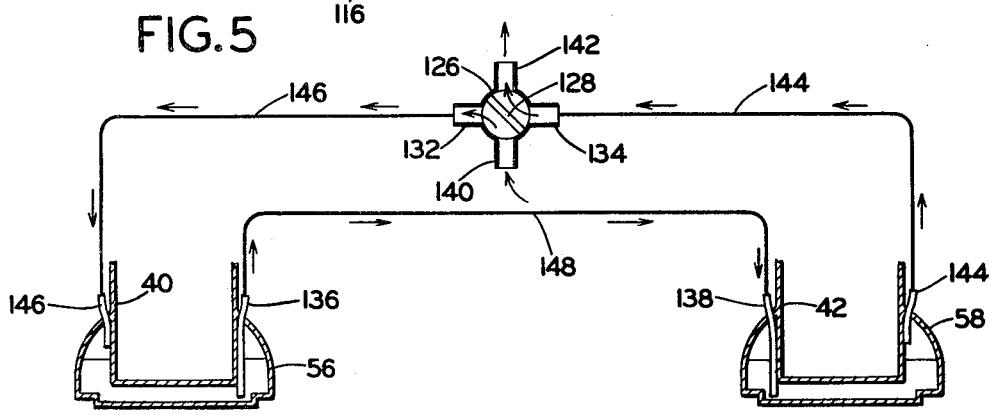
FIG. 7 is a schematic diagram showing the transfer of balancing fluid from the left hand storage tank to the right hand storage tank during a static balancing mode of operation.

Referring to FIG. 9, the lower portion of female coupler 70 contains a first compartment 118 housing valve servo 124 and a second compartment 122 housing rotary valve 126. Servo 124 is a conventional disc servo having a rotor 132 coupled to valve rotor 128. The servo 124, in response to signals developed by circuit 120, indexes the valve rotor between the positions shown in FIGS. 7 and 8 within stator 130 of the valve 126. Stator 130 contains balancing fluid transfer channels 132 and 134 connected, respectively, to fluid lines 146 and 144 extending to storage tanks 56 and 58. The valve stator 130 also contains a vacuum passage 140 and air passage 142 (shown respectively in FIGS. 9 and 1). When the rotor 128 of valve 126 is in a first position, shown in FIG. 7, communication is established between passageways 134 and 142 and also between passageways 140 and 132. Negative pressure or suction is thus created in fluid line 144 and positive air pressure is created in fluid line 146. The positive pressure differential between storage tank 56 and storage tank 58 thereby created in transfer line 148, causes balancing fluid to be transferred through line 148 from the tank 56 to the tank 58, as shown in FIG. 7.

When the valve rotor 128 is indexed in a second position, as shown in FIG. 8, a positive air pressure is created in line 44 whereas a negative pressure or suction is created in line 146. The result now is that the negative pressure differential created in transfer line 148 between storage tanks 56 and 58 causes balancing fluid to be transferred from the tank 58 to the tank 56 through line 148.

Pressure transducers 50 and 52 are preferably of the standrd piezoelectric type adapted to generate voltages as a function of applied pressures. Each transducer generates a voltage having a magnitude that is a function of the weight of the corresponding sample container 40 or 42 and its contents caused by contact pressure of the pressure pad 48 against transducers 50, 52. The signals that are generated by transducers 50 and 52 are processed in circuitry 120 (FIG. 10) located externally to the centrifuge 20. The transducer signals are amplified, respectively, in high input impedance amplifier $A_1$ and $A_2$ and supplied to the input terminals of a comparator 150 as a difference voltage $V_{DIFF}=(VA_1n-VA_2)$. Comparator 150 is a conventional analog signal comparator having the dead band transfer function characteristic shown in FIG. 11. If the difference voltage $V_{DIFF}$ generated by amplifiers $A_1$ and $A_2$ is less (more negative) than $-V_a$, the comparator 150 generates a negative polarity drive signal $-V_1$ to servo 124 to index valve rotor 128 to a first position, shown in FIG. 7. When $V_{DIFF}$ is greater (more positive) than $+V_a$, on the other hand, the comparator 150 generates an opposite polarity signal $-V_1$ to the servo 120 to index the valve rotor 128 in an opposite direction to a second position shown in FIG. 8.

Also connected to the outputs of amplifiers $A_1$ and $A_2$ is a conventional zero detector 152 which supplies an energizing signal to solenoid coil 64 only when the pressure signals generated by transducers 50, 52 are equal. Thus, solenoid coil 64 is energized to decouple the male coupler 66 and female coupler 70 only when there is a balanced weight condition between the sample containers 40, 42. When there is a weight imbalance, however, coil 64 is de-energized by zero detector 152 enabling the male coupler 66 to index downwardly under the force of gravity into contact with the female coupler 70. Simultaneously, the external vacuum source 59 (FIG. 1) is turned on by a control signal generated by invertor 153. The vacuum thus developed in vacuum line 58 tends to retain the male and female couplers 66, 70 together in mating position. Vacuum source 59 is turned off when coil 64 is re-energized following balancing.

The dead band region of the graph between $-V_a$ and $+V_a$ on the abscissa defines the region about zero on the abscissa within which the rotor 26 and load are considered to be balanced. Thus, if $V_{DIFF}$ is less than -51 $V_a|$, the value rotor 128 is not indexed between rotary positions; instead, solenoid coil 64 is energized by zero detector 152 as discussed above to separate male coupler 66 from female coupler 70 and to apply a logic one signal to one input of an AND gate 154, rotation of the centrifuge rotor 26 by motor 22 being enabled by a centrifuge command signal applied from an external switch (not shown) to the second input of the gate. Thus, centrifuging of the samples in containers 40, 42 cannot be made unless a balanced rotor condition exists, as defined by the output of zero detector 152. Accordingly, and of particular importance, it is impossible to cause the centrifuge rotor 26 to open in an unbalanced condition, and when spinning is applied to the rotor, there is assurance that no substantial weight imbalance exists.

In operation, the sample containers 40 and 42 are first loaded with inserts containing the samples to be centrifuged. Coil 64 is initially energized causing couplers 66 and 70 to be separated. In the automatic balancing mode of operation, which is provided prior to each centrifuge run, coil 64 is de-energized causing male coupler 66 to engage female coupler 70. A spin command signal is prevented from being supplied to gate 154 in the balancing mode of operation by external switching (not shown). With the two couplers 66, 70 mating, the pressure transducers 50, 52 are connected to the input of signal processing and control circuitry 120 and the output of servo drive amplifier $A_4$ is connected to servo 124. Signals generated by transducers 50 and 52 in response to pressure applied thereto by pressure arm 44 are amplified and compared in circuit 120 to drive servo 124 which indexes rotor valve 128, if necessary, into one of the two positions to establish weight balance between sample container 40 and sample container 42. Pressure supplied to the valve 126 through the two fluid lines 144 and 146 now re-distributes balancing fluid between storage tanks 50 and 52 until comparator 150 indicates a balanced condition existing within the predetermined limits $|V_a|$. Upon condition of weight balance indicated by a substantially zero, voltage differential between the outputs of amplifiers $A_1$ and $A_2$, servo 124 is de-energized by comparator 150 and solenoid 64 is energized by zero detector 152 to withdraw the male coupler 66 back to the upper position, shown in FIG. 4. Zero detector 152 also generates a positive signal to one input of the AND gate 154 which energizes and rotor drive motor 22 in response to a manually generated command signal applied to the remaining input of the AND gate. Thus, motor 22 is turned on only if sample containers 40 and 42 and contents are balanced as measured by pressure transducers 50 and 52; the rotor 26 can never be rotated unless balanced.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

I claim:

1. A self balancing centrifuge, comprising:

a motor mounted on a support structure and having a vertical drive shaft;

a horizontal rotor mounted on said shaft and coupled thereto for spinning;

first and second sample containers supported, respectively, on opposite ends of said rotor;

means for distributing a balancing fluid selectively between said sample containers;

means for detecting any weight imbalance between said containers;

means responsive to said detecting means for disabling said motor and for controlling said fluid distributing means to balance said rotor and sample containers prior to spinning by said motor;

means for generating a command signal; and means responsive to said detecting means and said command signal for enabling said motor to spin said rotor only when said containers are balanced.

2. The centrifuge of claim 1, wherein each of said sample containers contains a storage tank for balancing fluid.

3. The centrifuge of claim 2, wherein said rotor is pivotably supported on and keyed to rotate with said shaft; and said detecting means includes means for detecting pivoting of said rotor prior to rotation thereof of said motor shaft.

4. The centrifuge of claim 3, wherein said pivoting detecting means includes a horizontal pressure member positioned beneath said rotor, and pressure transducer means located between and in contact with said rotor and said pressure member, said pressure transducer means generating electrical signals that are functions of weights of said rotor and said sample containers and contents.

5. The centrifuge of claim 4, wherein said pressure transducer means includes first and second pressure transducers located on said rotor on opposite sides respectively of said motor shaft and spaced equally therefrom, said transducers generating first and second electrical signals that are functions respectively of the weights of said rotor and sample containers and contents on opposite sides of said motor shaft.

6. The centrifuge of claim 4, wherein said controlling means includes means for comparing said first and second transducer signals and for generating a difference signal that is a function of a weight imbalance between contents of said sample containers; and means responsive to said difference signal for operating said controlling means.

7. The centrifuge of claim 6 wherein said supplying means includes a first coupler in fluid communication with a source of pneumatic pressure and a second coupler in fluid communication with said sample containers; and valve means responsive to said detector means for directing fluid flow under pressure selectively between said storage tanks in said first and second sample containers.

8. The centrifuge of claim 7, wherein said valve means is located within said second coupler.

9. The centrifuge of claim 7, wherein said detecting means further includes circuit means comprising means for amplifying said first and second transducer signals, comparator means responsive to said amplified transducer signals for generating an imbalance signal, and driver means responsive to said imbalance signal for controlling said valve means.

10. The centrifuge of claim 9, wherein said valve means includes servo means for rotating said valve means for controlling flow of balancing fluid selectively between said first and second sample containers.

11. The centrifuge of claim 10, wherein said first and second couplers include electrical terminal means for establishing electrical connections therebetween when said couplers are mated.

12. The centrifuge of claim 11, wherein facing surfaces of said first and second couplers include mutually complementary, annular ridges and valleys that coincide when said first and second couplers are mated, and said electrical terminal means include terminals plated on opposed pairs of ridges and valleys for establishing electrical contact between said couplers independent of angular relative orientation therebetween.

13. The centrifuge of claim 12, including solenoid means responsive to said detecting means for indexing one of said couplers relative to the other for balancing and run modes of operation.

14. A self balancing centrifuge, comprising a motor; a horizontal rotor rotatable about a center of rotation by said motor; first and second sample containers carried, respectively, on opposite ends of said rotor; first and second balancing tanks carried by said rotor respectively on opposite sides of the center of rotation for storing a balancing fluids; means for detecting any weight imbalance of said rotor about a center of rotation; valve means responsive to said detecting means for distributing the balancing fluid selectively between said balancing tanks prior to rotation of said rotor; means for generating a spin command signal; and means responsive to said detecting means and to the command signal for operating said motor to spin said balanced rotor at a rate of speed sufficiently high to centrifuge samples within said sample containers.

15. A method of balancing a centrifuge of a type comprising a horizontal rotor; first and second sample containers carried, respectively, on opposite ends of said rotor; motor means for spinning said rotor to centrifuge fluid samples within said containers, each of said containers including balancing fluid storage means; said centrifuge further comprising a balancing fluid and means for controlling flow of said fluid between said storage means, comprising the steps of loading said sample containers with samples to be centrifuged;

prior to spinning of said rotor;

(1) detecting any weight imbalance between said loaded sample containers; and (2) balancing the rotor by distributing the balancing fluid selectively between the fluid storage means in the containers in response to said detecting step;

and then after a balanced condition is detected:

operating said motor means to spin said rotor.

* * * * *